US006435560B1

(12) United States Patent
Pruner

(10) Patent No.: US 6,435,560 B1
(45) Date of Patent: Aug. 20, 2002

(54) REUSABLE CHECKLIST DEVICE

(76) Inventor: Scott A. Pruner, 1960 Parrot St., San Diego, CA (US) 92105

( * ) Notice: Subject to any disclaimer, the term of this patent is extended or adjusted under 35 U.S.C. 154(b) by 0 days.

(21) Appl. No.: 09/904,771

(22) Filed: Jul. 13, 2001

(51) Int. Cl.[7] ..... B42D 1/00

(52) U.S. Cl. ..... 281/39; 281/30; 281/45; 283/66.1

(58) Field of Search ..... 281/39, 33, 38, 281/15.1, 21.1, 45, 51, 30; 283/56, 66.1, 115, 117; 402/4, 70, 73, 79; 434/410; 401/292

(56) References Cited

U.S. PATENT DOCUMENTS

| | | | | | |
|---|---|---|---|---|---|
| 536,395 | A | * | 3/1895 | Roberts | 281/39 |
| 1,407,239 | A | * | 2/1922 | Weiss | 281/39 |
| 1,830,030 | A | | 11/1931 | Klein | |
| D180,429 | S | | 6/1957 | Taylor | |
| 3,579,871 | A | * | 5/1971 | Eddington | 281/39 |
| D277,875 | S | | 3/1985 | Waggoner, Jr. | |
| 5,261,702 | A | | 11/1993 | Mayfield | |
| 5,431,450 | A | | 7/1995 | Coleman | |
| D377,948 | S | | 2/1997 | Pruhs | |
| 5,788,073 | A | | 8/1998 | Suryk | |

* cited by examiner

*Primary Examiner*—William Fridie, Jr.

(57) ABSTRACT

A reusable checklist device for providing a checklist which is erasable. The reusable checklist device includes a panel having a front surface, a back surface, an upper edge, a bottom edge, a first side edge, and a second side edge. The panel is substantially rigid. A plurality of number indicia is located on the front surface and extends between the upper and bottom edges. Each of a plurality of horizontal lines extends between one of the numerals and the second side edge. An erasable writing utensil is adapted for removably writing on the front surface. A sleeve has an open end and is attached to the front surface. The erasable writing utensil is extendable into the open end of the sleeve such that the erasable writing utensil is removably stored in the sleeve.

7 Claims, 2 Drawing Sheets

REUSABLE CHECKLIST DEVICE

BACKGROUND OF THE INVENTION

1. Field of the Invention

The present invention relates to checklist systems and more particularly pertains to a new reusable checklist device for providing a checklist which is erasable.

2. Description of the Prior Art

The use of checklist systems is known in the prior art. More specifically, checklist systems heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,788,073; U.S. Pat. No. 5,261,702; U.S. Pat. No. 5,431,450; U.S. Des. Pat. No. 377,948; U.S. Des. Pat. No. 277,875; U.S. Des. Pat. No. 180,429; and U.S. Pat. No. 1,830,030.

While these devices fulfill their respective, particular objectives and requirements, the aforementioned patents do not disclose a new reusable checklist device. The inventive device includes a panel having a front surface, a back surface, an upper edge, a bottom edge, a first side edge, and a second side edge. The located on the front surface and extends between the upper and bottom edges. Each of a plurality of horizontal lines extends between one of the numerals and the second side edge. An erasable writing utensil is adapted for removably writing on the front surface. A sleeve has an open end and is attached to the front surface. The erasable writing utensil is extendable into the open end of the sleeve such that the erasable writing utensil is removably stored in the sleeve.

In these respects, the reusable checklist device according to the present invention substantially departs from the conventional concepts and designs of the prior art, and in so doing provides an apparatus primarily developed for the purpose of providing a checklist which is erasable.

SUMMARY OF THE INVENTION

In view of the foregoing disadvantages inherent in the known types of checklist systems now present in the prior art, the present invention provides a new reusable checklist device construction wherein the same can be utilized for providing a checklist which is erasable.

The general purpose of the present invention, which will be described subsequently in greater detail, is to provide a new reusable checklist device apparatus and method which has many of the advantages of the checklist systems mentioned heretofore and many novel features that result in a new reusable checklist device which is not anticipated, rendered obvious, suggested, or even implied by any of the prior art checklist systems, either alone or in any combination thereof.

To attain this, the present invention generally comprises a panel having a front surface, a back surface, an upper edge, a bottom edge, a first side edge, and a second side edge. The panel is substantially rigid. A plurality of number indicia is located on the front surface and extends between the upper and bottom edges. Each of a plurality of horizontal lines extends between one of the numerals and the second side edge. An erasable writing utensil is adapted for removably writing on the front surface. A sleeve has an open end and is attached to the front surface. The erasable writing utensil is extendable into the open end of the sleeve such that the erasable writing utensil is removably stored in the sleeve.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new reusable checklist device apparatus and method which has many of the advantages of the checklist systems mentioned heretofore and many novel features that result in a new reusable checklist device which is not anticipated, rendered obvious, suggested, or even implied by any of the prior art checklist systems, either alone or in any combination thereof.

It is another object of the present invention to provide a new reusable checklist device which may be easily and efficiently manufactured and marketed.

It is a further object of the present invention to provide a new reusable checklist device which is of a durable and reliable construction.

An even further object of the present invention is to provide a new reusable checklist device which is susceptible of a low cost of manufacture with regard to both materials and labor, and which accordingly is then susceptible of low prices of sale to the consuming public, thereby making such reusable checklist device economically available to the buying public.

Still yet another object of the present invention is to provide a new reusable checklist device which provides in the apparatuses and methods of the prior art some of the advantages thereof, while simultaneously overcoming some of the disadvantages normally associated therewith.

Still another object of the present invention is to provide a new reusable checklist device for providing a checklist which is erasable.

Yet another object of the present invention is to provide a new reusable checklist device which includes a panel having a front surface, a back surface, an upper edge, a bottom edge, a first side edge, and a second side edge. The panel is substantially rigid. A plurality of number indicia is located on the front surface and extends between the upper and bottom edges. Each of a plurality of horizontal lines extends between one of the numerals and the second side edge. An erasable writing utensil is adapted for removably writing on the front surface. A sleeve has an open end and is attached to the front surface. The erasable writing utensil is extendable into the open end of the sleeve such that the erasable writing utensil is removably stored in the sleeve.

Still yet another object of the present invention is to provide a new reusable checklist device that allows a user to place erasable and non-erasable items on the same checklist.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
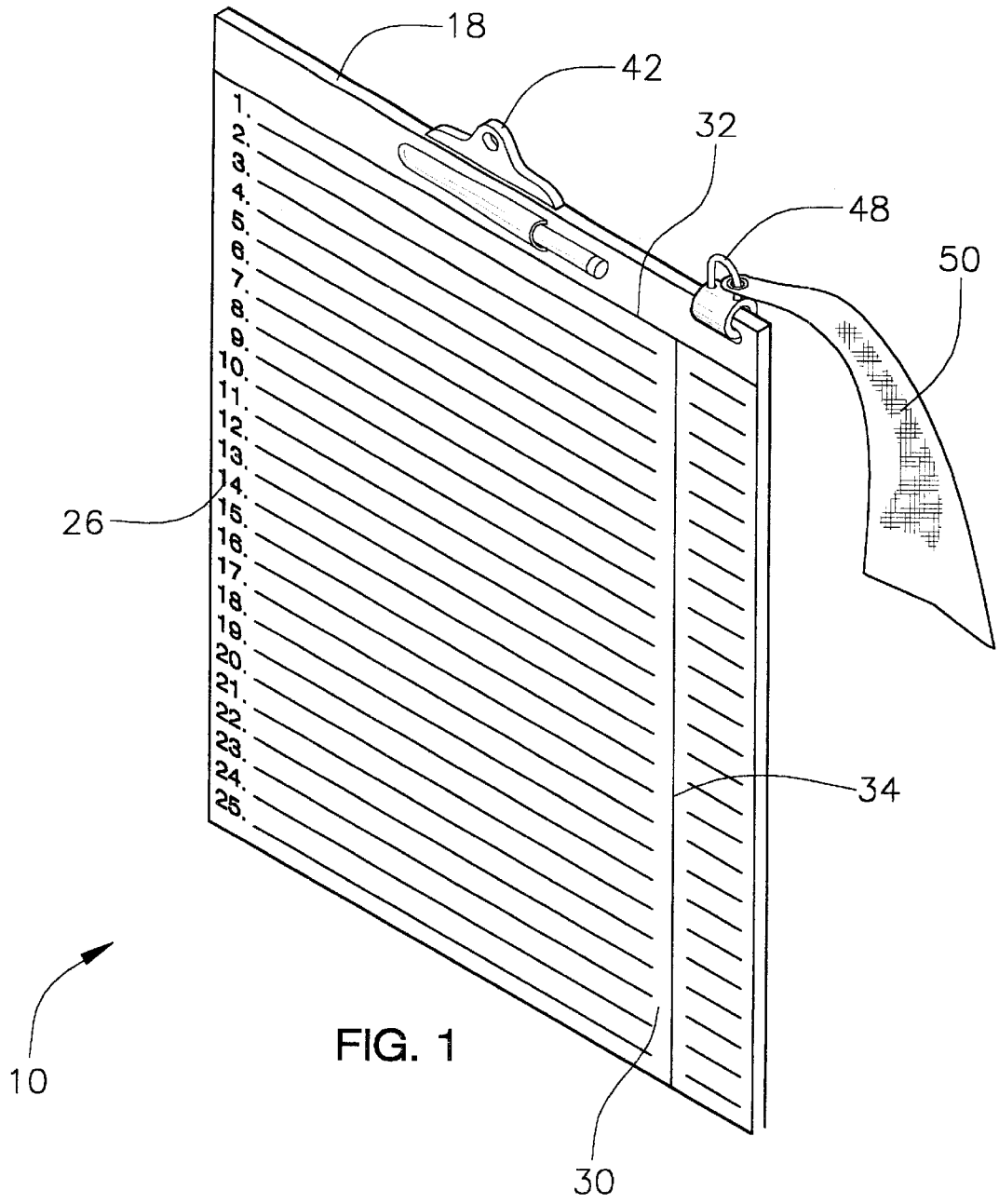
FIG. 1 is a schematic perspective view of a new reusable checklist device according to the present invention.
Figure 2:
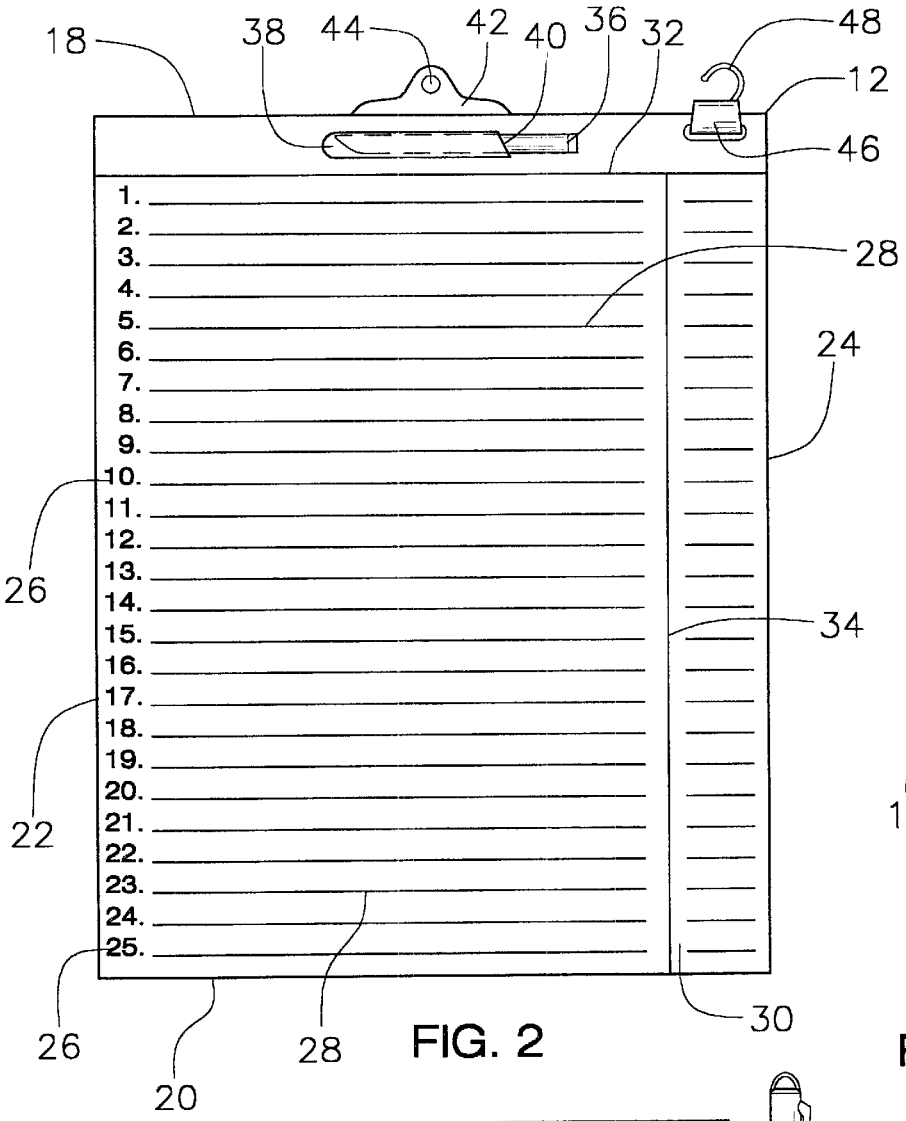
FIG. 2 is a schematic front view of the present invention.
Figure 3:
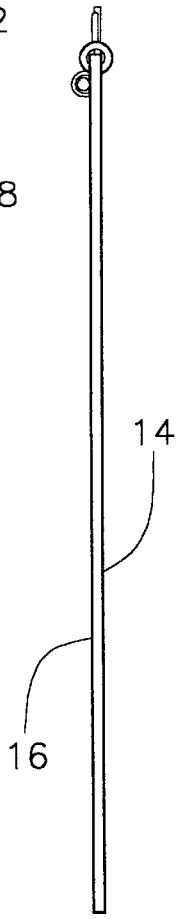
FIG. 3 is a schematic side view of the present invention.
Figure 4:
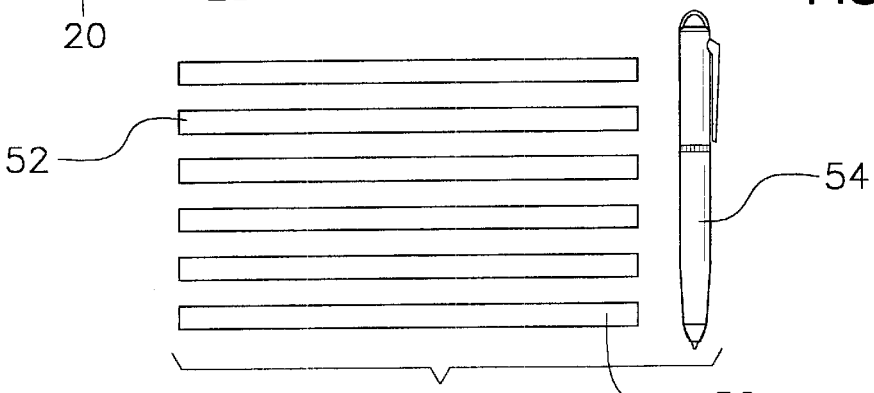
FIG. 4 is a schematic front view of the strips of the present invention.

With reference now to the drawings, and in particular to FIGS. 1 through 4 thereof, a new reusable checklist device embodying the principles and concepts of the present invention and generally designated by the reference numeral 10 will be described.

As best illustrated in FIGS. 1 through 4, the reusable checklist device 10 generally comprises a panel 12 having a front surface 14, a back surface 16, an upper edge 18, a bottom edge 20, a first side edge 22, and a second side edge 24. The panel 12 is substantially rigid and preferably comprises a plastic material. A plurality of number indicia 26 is located on the front surface and extends between the upper and bottom edges. The number indicia 26 is positioned adjacent to the first side edge 22 and ideally depicts numerals I through 25 in consecutive order. Each of a plurality of horizontal lines 28 extends between one of the numerals 26 and the second side edge 24. Each of the horizontal lines 28 has a break 30 therein positioned nearer the second side edge 24 than the first side edge 22. A border line 32 extends between the first 22 and second 24 side edges and is positioned between an upper most of the numerals 26 and the upper edge 18. A vertical line 34 extends from the border line 32 to the bottom edge 20 and is positioned in the breaks 30 of the horizontal lines 28.

An erasable writing utensil 36 is adapted for removably writing on the front surface 14. The erasable writing utensil 36 is a conventional one such as an erasable marker or soap stone marker.

A sleeve 38 having an open end 40 is attached to the front surface 14. The erasable writing utensil 36 is extendable into the open end 40 of the sleeve 38 such that the erasable writing utensil 36 is removably stored in the sleeve 38.

A tab 42 is attached to the upper edge 18. The tab 42 has an aperture 44 extending therethrough. The panel 12 may be hung from the tab 42.

A loop 46 is attached to the upper edge 18 of the panel 12. A hook 48 is rotatably coupled to the loop 46. A cloth member 50 is removably attached to the hook 48. The hook 48 may be a clip for clipping onto the cloth member 50. The cloth member 50 is used for removing markings on the panel 12.

Each of a plurality of elongate strips 52 has a side having a pressure sensitive adhesive thereon for adhering the elongate strips to the panel 12. A permanent writing utensil 54, such as a conventional permanent marker, is adapted for writing on the elongate strips 52. The strips 52 are positionable between a pair of adjacent horizontal lines 28 and generally extendable between one of the numerals 26 and the vertical line 34.

In use, the device 10 is used as a checklist for multiple needs such as groceries or traveling needs. The elongate strips 52 allow the user to permanently keep certain items on the checklist by using a permanent marker 54. The elongate strips 52 may be removed from the panel 12 if they are not needed.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A reusable checklist and organizer comprising:

a panel having a front surface, a back surface, an upper edge, a bottom edge, a first side edge, and a second side edge, said panel being substantially rigid, a plurality of number indicia being located on said front surface and extending between said upper and bottom edges, said number indicia being positioned adjacent to said first side edge and depicting numerals in consecutive order, each of a plurality of horizontal lines extending between one of said numerals and said second side edge;

an erasable writing utensil being adapted for removably writing on said front surface;

a sleeve having an open end and being attached to said front surface, said erasable writing utensil being extendable into said open end of said sleeve such that said erasable writing utensil is removably stored in said sleeve; and a loop being attached to said upper edge of said panel, said loop having a hook rotatably coupled to said loop; and a cloth member being removably attached to said hook.

2. A reusable checklist and organizer comprising:

a panel having a front surface, a back surface, an upper edge, a bottom edge, a first side edge, and a second side edge, said panel being substantially rigid, a plurality of number indicia being located on said front surface and extending between said upper and bottom edges, said number indicia being positioned adjacent to said first side edge and depicting numerals in consecutive order, each of a plurality of horizontal lines extending between one of said numerals and said second side edge;

an erasable writing utensil being adapted for removably writing on said front surface;

a sleeve having an open end and being attached to said front surface, said erasable writing utensil being extendable into said open end of said sleeve such that said erasable writing utensil is removably stored in said sleeve; and a plurality of elongate strips having a side having a pressure sensitive adhesive thereon for adhering said elongate strips to said panel, a permanent writing utensil being adapted for writing on said elongate strips.

3. A reusable checklist and organizer comprising:

a panel having a front surface, a back surface , an upper edge, a bottom edge, a first side edge, and a second side edge, said panel being substantially rigid and comprising a plastic material, a plurality of number indicia being located on said front surface and extending between said upper and bottom edges, said number indicia being positioned adjacent to said first side edge and depicting numerals 1 through 25 in consecutive order, each of a plurality of horizontal lines extending between one of said numerals and said second side edge, each of said horizontal lines having a break therein positioned nearer said second side edge than said first side edge, a border line extending between said first and second side edges and being positioned between an upper most of said numerals and said upper edge, a vertical line extending from said border line to said bottom edge and being positioned in said breaks of said horizontal lines;

an erasable writing utensil being adapted for removably writing on said front surface;

a sleeve having an open end and being attached to said front surface, said erasable writing utensil being extendable into said open end of said sleeve such that said erasable writing utensil is removably stored in said sleeve;

a tab being attached to said upper edge, said tab having an aperture extending therethrough, wherein said panel may be hung from said tab;

a loop being attached to said upper edge of said panel, said loop having a hook rotatably coupled to said loop;

a cloth member being removably attached to said hook; and a plurality of elongate strips having a side having a pressure sensitive adhesive thereon for adhering said elongate strips to said panel, a permanent writing utensil being adapted for writing on said elongate strips, said strips being positionable between a pair of adjacent horizontal lines and generally extendable between one of said numerals and said vertical line.

4. The reusable checklist as in claim 1, wherein each of said horizontal lines has a break therein positioned nearer said second side edge than said first side edge, a border line extending between said first and second side edges and being positioned between an upper most of said numerals and said upper edge, a vertical line extending from said border line to said bottom edge and being positioned in said breaks of said horizontal lines.

5. The reusable checklist as in claim 1, further including a tab being attached to said upper edge, said tab having an aperture extending therethrough, wherein said panel may be hung from said tab.

6. The reusable checklist as in claim 2, wherein each of said horizontal lines has a break therein positioned nearer said second side edge than said first side edge, a border line extending between said first and second side edges and being positioned between an upper most of said numerals and said upper edge, a vertical line extending from said border line to said bottom edge and being positioned in said breaks of said horizontal lines.

7. The reusable checklist as in claim 2, further including a tab being attached to said upper edge, said tab having an aperture extending therethrough, wherein said panel may be hung from said tab.

* * * * *